United States Patent [19]

Conti

[11] 4,127,241

[45] Nov. 28, 1978

[54] CABLE REEL BRAKE APPARATUS

[76] Inventor: Armand R. Conti, 3464 N. Wendover Cir., Youngstown, Ohio 44511

[21] Appl. No.: 830,516

[22] Filed: Sep. 6, 1977

[51] Int. Cl.[2] ..... B65H 59/04

[52] U.S. Cl. ..... 242/156.2; 188/73.3

[58] Field of Search ..... 242/156, 156.2, 155 R, 242/155 BW, 75.4; 188/73.3, 73.6, 71.1, 18 A

[56] References Cited

U.S. PATENT DOCUMENTS

| | | | |
|---|---|---|---|
| 2,657,772 | 11/1953 | Chamberlain | 188/73.3 X |
| 2,756,844 | 7/1956 | Chamberlain et al. | 188/73.3 |
| 3,203,640 | 8/1965 | Garnett | 242/155 BW X |
| 3,349,871 | 10/1967 | Walther et al. | 188/73.3 |
| 3,465,981 | 9/1969 | Byrt | 242/156.2 X |
| 3,482,655 | 12/1969 | Walther | 188/73.3 X |
| 3,595,529 | 7/1971 | Stull et al. | 242/156.2 X |
| 3,841,446 | 10/1974 | Gravel, Jr. | 188/73.3 X |
| 4,050,647 | 9/1977 | Linam | 242/156 X |

FOREIGN PATENT DOCUMENTS

| | | | |
|---|---|---|---|
| 138,761 | 2/1920 | United Kingdom | 242/75.4 |

*Primary Examiner*—Stanley N. Gilreath

*Attorney, Agent, or Firm*—Thomas H. Murray; Clifford A. Poff

[57] ABSTRACT

Rotation of a supply reel for cable or the like is controlled by a brake apparatus. The supply reel is supported on pedestals by an arbor which includes a rotor having a disc coupled to the supply reel by a drive arm so that as the reel turns the disc rotates. A piston and cylinder assembly carried by a brake frame urges brake pads into frictional engagement with opposite sides of the disc. Spring-loaded latches on the reel support pedestals releasably support the brake frame and transfer braking torque to the reel support pedestals. The brake frame includes plates that are urged apart by a spring so that the brake pads only engage opposite sides of the disc when fluid pressure from a second piston and cylinder assembly is developed by an actuating lever.

11 Claims, 2 Drawing Figures

CABLE REEL BRAKE APPARATUS

BACKGROUND OF THE INVENTION

This invention relates to a brake apparatus for a supply reel containing a cable or the like, and more particularly to a disc brake assembly embodying a construction of parts whereby the brake pads are normally maintained out of contact with the disc until acted upon by fluid pressure and wherein unlatching of brake housing parts facilitates replacement of an emptied supply reel.

It is the usual practice by utility companies to transport cable used to transmit electrical power and telephone communication on relatively large supply reels to a job site. The reel is usually supported by saddles on pedestals for rotation so that the cable can be drawn from the reel. Some form of brake apparatus is desirable, if not actually required, to control rotation, overspinning and surging of the reel as the cable is paid out. Overspinning is an unwinding of an unwanted length of coil which can be controlled to some extent by the speed at which the cable is pulled from the reel. Surging developes from the elasticity of the pulling cable and can destroy the cable "eye" used for pulling. It is a time consuming and laborious operation to rewind a length of cable that has been unintentionally uncoiled simply because rotation of the reel cannot be stopped. Many times, as the cable is being payed-out, a workman is below the supply reel in the manhole guiding the cable. If the reel should overspin, he could be injured. Moreover, a surge control is needed to prevent damage due to shock.

The present invention is designed to overcome these problems as well as others which arise when it is desired to utilize a brake apparatus to control rotation of a supply reel for a cable. The brake apparatus must, of course, be an economical capital investment and at the same time the apparatus must be constructed in such a manner so as to facilitate the substitution of an emptied reel with one containing a supply of cable. The energy which must be dissipated in the form of heat generated by the brake device is relatively large because of the size and weight of the storage reel. Even when a disc-brake principle is employed according to the present invention, it has been discovered that efficient braking can only be achieved by avoiding continuous frictional engagement by the brake pads with the rotor. Therefore, one of the basic concepts of the present invention is that frictional contact should only exist between the disc and the brake pads during the actual braking mode of operation. In less efficient types of brake devices, such as a band-type brake, excessive quantities of heat are developed very rapidly, producing poor and inefficient braking that is unacceptable for controlling the rotation of the massive cable storage reel.

SUMMARY OF THE INVENTION

It is an object of the present invention to provide a brake apparatus employing a disc-brake principle for use with a supply reel containing a cable or the like.

It is a further object of the present invention to provide an improved construction and relationship of parts to provide a disc-brake apparatus to apply effective braking action to a supply reel for a cable or the like wherein forces are developed to urge brake pads apart so as to minimize or even eliminate frictional engagement with face surfaces of the brake disc during periods of time when the brake is non-functional.

It is still another object of the present invention to provide a disc-brake apparatus for a supply reel containing a cable or the like wherein the brake apparatus is retained in an operative relation by latch members carried by support pedestals for the reel so that the brake apparatus may be unlatched and disassembled to enable replacement of an emptied reel with a reel containing a cable.

More specifically, according to the present invention, there is provided a brake apparatus in combination with a supply reel for a cable or the like wherein the combination comprises a reel support including an arbor to carry the supply reel for rotation about an axis, a rotor including a disc supported by the arbor for rotation about an axis, means engageable with the reel to drivingly couple the rotor to the supply reel, a brake frame including brake pads for engaging opposed arcuate segments of the disc, a piston and cylinder assembly supported by the brake frame, latch means on the reel support to releasably engage the brake frame for supporting the brake pads at opposite sides of the disc, and means to deliver a pressurized fluid medium to the piston and cylinder assembly to move the brake pads into frictional engagement with the disc for controlling rotation of the supply reel.

In the preferred form of the present invention, tapered reel adapter locks prevent left to right shifting and accommodate various sized holes in the reel. Resilient means are supported by the brake frame for urging the brake pads out of contact with the disc. The brake frame includes two support plates maintained at a spaced-apart relation by a spacer section with means to slidably interconnect the support plates while acted upon by the resilient means. The means for engaging the supply reel includes an arm extending radially from the rotor and a sprag projecting from the extended end of the arm for engaging the reel. The support plates forming the brake frame preferably include surfaces for interlocking engagement with the latch members. The latch members are secured to the reel support.

According to a further feature of the present invention, the brake apparatus further includes a second piston and cylinder assembly to deliver through a conduit the pressurized fluid medium to the piston and cylinder assembly supported by the brake frame. A lever connected to the piston of the second piston and cylinder assembly is used to pressurize the fluid medium. The second piston and cylinder assembly and the lever for actuation thereof are supported by a bracket carried by the reel support.

These features and advantages of the present invention as well as others will be more fully understood when the following description is read in light of the accompanying drawings, in which.

Figures 1, 3:
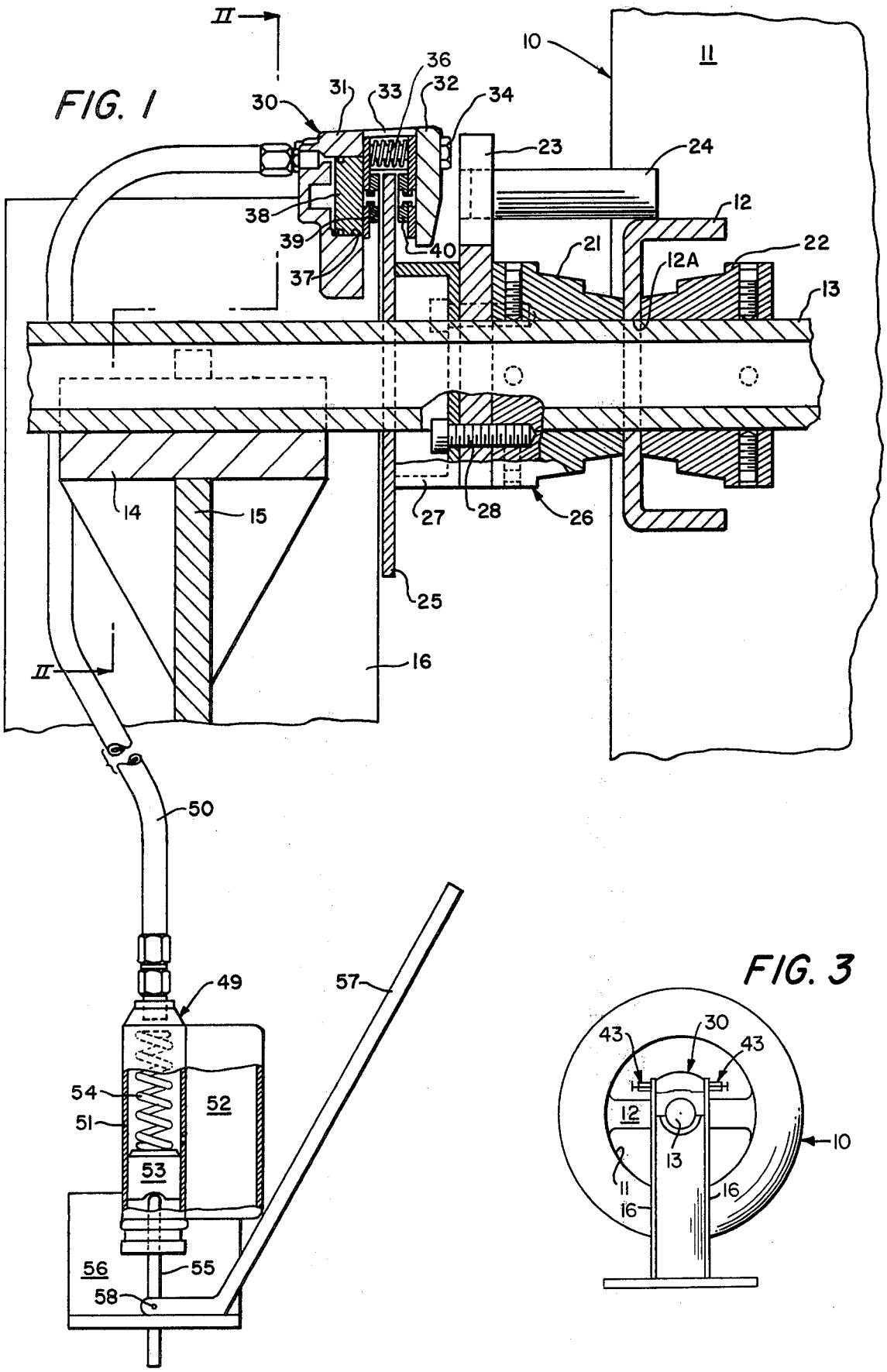
FIG. 1 is an elevational view, in section, taken through a vertical plane containing the rotational axis of an arbor for a support reel including a brake apparatus embodying the features of the present invention.
FIG. 3 is a small scale illustration of a cable reel on the support apparatus of the present invention.
Figure 2:
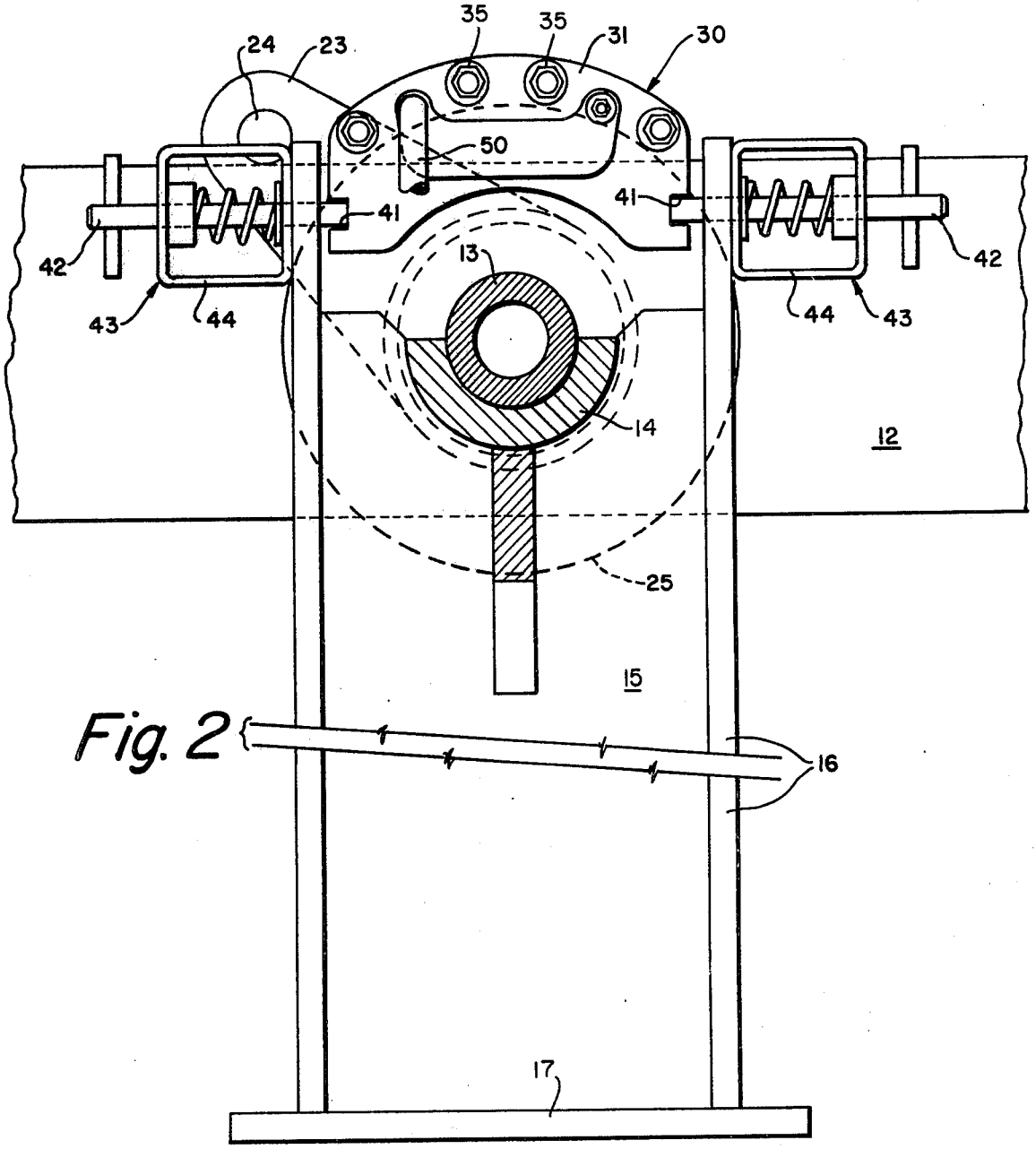
FIG. 2 is a sectional view taken along line II—II of FIG. 1.

In FIGS. 1 and 2, there is illustrated a supply reel 10 having a sleeve 11 upon which a cable or the like is wound. As shown in FIG. 3 of the drawings, spaced-apart side plates maintain the cable in coiled convolutions upon the sleeve 11. Within the sleeve, at each end thereof, a diametrically-extending brace 12, made of U-shaped angle iron, is welded or otherwise secured to the sleeve. Each brace 12 includes a bored hole 12A arranged in a coaxial relation with the rotational axis of the reel. An arbor 13 is passed through the bored holes 12A. The arbor projects beyond the brace 12 at each end of the reel onto a saddle support 14 that is carried by a bracket 15 between side plates 16. A support pedestal is formed by the side plates and a carrier plate 17 which is supported by a suitable foundation or, if desired, upon the bed surface of a vehicle used to transport a reel.

Collars 21 and 22 are secured by set screws or the like at the arbor 13 at opposite sides of the brace 12. The collars include tapered steps to allow for use with bore holes 12A of different diameters. At the outer end of collar 21, an arm 23 extends radially with respect to the arbor 13. The projected end of arm 23 carries a shaft 24 that extends in a spaced, parallel relation to the arbor 13 and engages the brace 12. The arm 23 and shaft 24 form a sprag which drivingly interconnects the reel 11 with a disc 25 forming part of a rotor assembly 26. The rotor assembly includes a collar 21, arm 23 and a mounting collar 27. The mounting collar is welded or otherwise attached to the disc 25. Bolts 28 interlock the collar 21 with arm 23 and collar 27.

A brake frame 30 includes plates 31 and 32 that are held in a spaced-apart relation and disposed at opposite sides of disc 25 by a spacer member 33. Bolts 34 are passed through openings in plate 32 through the spacer 33 and through openings in plate 31. Nuts 35 are secured to the extended ends of the bolts 34. Springs 36 form resilient members that urge brake pad support plates away from each other by sliding movement along bolts 34. The plate 31 includes a cylindrical bore 37 into which a piston 38 is received. The piston contacts a support plate for a brake pad 39 arranged for frictional engagement with one face surface of disc 25. Plate 36 carries a support plate which, in turn, supports a brake pad 40 arranged to engage the opposite face surface of disc 25. As best shown in FIG. 2, plate 31 of the brake frame 30 includes slotted openings 41 at opposite ends thereof to receive the ends of shafts 42 forming part of latch devices 43. These latch devices include a frame 44 that is secured to the side plates 16 of the support pedestal. Springs are used to urge the shafts at opposite sides of the brake housing into the slotted openings 41. Handles are provided to retract the shafts 42 and thereby permit removal of the brake housing from the nested relation formed with the disc. Typically, the brake housing 30 is removed when it is desired to remove the arbor from the saddle support surfaces. In this way, a reel containing a supply of cable is loaded onto an arbor for support by support pedestals. The brake frame is then positioned so that brake pads 39 and 40 lie at opposite sides of the rotor after which shafts 42 are moved into the slotted openings 41.

According to the further features of the present invention, a second piston and cylinder assembly 49 is interconnected by a conduit 50 for continuous communication of hydraulic fluid with the piston and cylinder assembly formed by cylindrical bore 37 and piston 38. All check valves or the like are eliminated from the hydraulic fluid passageways so that the brake pads are retractable from a constant frictional engagement with the disc. The piston and cylinder assembly 49 includes a cylinder housing 51 with a reservoir 52 containing a supply of hydraulic fluid. The hydraulic fluid is passed into the cylinder through an opening located in the cylinder wall just above the end face of piston 53 when located in its retracted position. A spring 54 engages this end face of the piston to urge the piston downwardly against a push rod 55 that extends from the piston and cylinder assembly through an opening in a bracket 56. A lever 57 includes a bent end connected by a shaft 58 to the push rod 55. The bracket is secured to the reel support pedestal in a spaced relation below the arbor. Hydraulic fluid is pressurized by the piston and cylinder assembly on which the lever 57 is moved against the bracket.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. A brake apparatus in combination with a supply reel for a cable or the like, the combination comprising:

a reel support including an arbor for mounting said reel and a saddle to carry said arbor for rotation about an axis, said reel support further including side plates at either side of said saddle, a rotor including a disc supported by said arbor for rotation about said axis, means engageable with said reel to drivingly couple said rotor to said supply reel, a brake frame including brake pads for engaging opposed arcuate segments of said disc, said brake frame further including a support plate having openings at opposite sides thereof facing toward said side plates, a piston and cylinder assembly supported by said brake frame, resilient means supported by said brake frame for urging said brake pads out of contact with said disc, latch means including movable plungers carried by the side plates of said reel support to engage in the openings of the support plate of said brake frame for releasably supporting said brake frame and transferring brake torque from said brake pads to said reel support, and means to deliver a pressurized fluid medium to said piston and cylinder assembly to move the brake pads into frictional engagement with said disc for controlling rotation of said supply reel.

2. The combination according to claim 1 wherein the openings at opposite sides of the support plate of said frame include slotted openings for interlocking engagement with said latch means.

3. The combination according to claim 1 wherein said means engageable with said supply reel includes an arm extending radially from said rotor, and a sprag projecting from the extended end of said arm for engagement with said reel.

4. The combination according to claim 1 wherein said brake frame comprises two support plates maintained in a spaced-apart relation by a spacer section, and resilient means to urge said brake pads apart.

5. The combination according to claim 4 wherein one of said two support plates carries said piston and cylinder assembly while the piston thereof supports one of said brake pads at one side of said disc, and the other brake pad being supported by the other support plate at the opposite side of said disc.

6. The combination according to claim 1 wherein said means to deliver a pressurized fluid medium includes a second piston and cylinder assembly, and a conduit line in open communication with the cylinder portion of said piston and cylinder assembly.

7. The combination according to claim 6 wherein said means to deliver a pressurized fluid medium further includes an actuator arm coupled to the piston of said second piston and cylinder assembly.

8. The combination according to claim 7 wherein said actuator arm comprises a lever, a push rod, and means to pivotally couple one end of said push rod to the piston of said second piston and cylinder assembly.

9. The combination according to claim 8 further comprising a bracket to support said second piston and cylinder assembly and said lever.

10. The combination according to claim 7 wherein said actuator arm includes a lever having a bent end portion coupled to the piston of said second piston and cylinder assembly.

11. The combination according to claim 10 further comprising means to support the bent end portion of said lever for movement to pressurize a fluid medium by said second piston and cylinder assembly.

* * * * *